United States Patent [19]

Tokita et al.

[11] Patent Number: 5,029,256

[45] Date of Patent: Jul. 2, 1991

[54] COLOR CATHODE RAY TUBE

[75] Inventors: Kiyoshi Tokita, Fukaya; Toshinao Sone, Kumagaya; Michio Nakamura, Kamisato; Akira Fukuoka, Fukaya, all of Japan

[73] Assignee: Kabushik Kaisha Toshiba, Kawasaki, Japan

[21] Appl. No.: 391,925

[22] Filed: Aug. 10, 1989

[30] Foreign Application Priority Data

Aug. 11, 1988 [JP] Japan ..... 63-200614
Jul. 4, 1989 [JP] Japan ..... 1-172497

[51] Int. Cl.[5] ..... H01J 29/07
[52] U.S. Cl. ..... 313/407
[58] Field of Search ..... 313/402, 407, 408

[56] References Cited

U.S. PATENT DOCUMENTS 4,678,963 7/1987 Fonda ..... 313/405
4,694,216 9/1987 Morrell ..... 313/402

FOREIGN PATENT DOCUMENTS 59-207542 11/1984 Japan .
60-131733 7/1985 Japan .
62-278738 12/1987 Japan .
63-43242 2/1988 Japan .

*Primary Examiner*—Sandra L. O'Shea
*Attorney, Agent, or Firm*—Cushman, Darby & Cushman

[57] ABSTRACT

According to the color cathode ray tube of the present invention, a magnetic resistance section is provided between a shadow mask and a mask frame. The magnetic resistance section comprises at least one of magnetic resistance members and a gap which is provided between the shadow mask and the mask frame. The magnetic resistance section serves to reduce a landing error of electron beams on a phosphor screen.

14 Claims, 9 Drawing Sheets

COLOR CATHODE RAY TUBE

BACKGROUND OF THE INVENTION

1. Field of the Invention

The present invention relates to a color cathode ray tube, and, in particular, to an improvement of the structure wherein a shadow mask of the tube is mounted on a mask frame.

2. Description of the Related Art

FIG. 1 shows a conventional shadow mask type color cathode ray tube. A color cathode ray tube 1 comprises a panel section 2 including a faceplate 4, having a substantially rectangular shape, and a skirt 6 extending from the edge of the faceplate 4, and an envelope 11 including a funnel section 8 connected to the panel section 2 and a neck section 10 continuous to the funnel section 8. A vacuum is created in the cathode ray tube 1 by the panel section 2, funnel section 8 and neck section 10. An electron gun assembly 12 for producing three electron beams 13 is housed in the neck section 10. A deflecting system 14 is arranged on the outside of the cone section of the funnel section 8. The deflecting system 14 produces a magnetic field to deflect the electron beams 13 in a horizontal direction and in a vertical direction. A phosphor screen 16 is formed on the inner surface of faceplate 4 of panel section 2. Within the tube 1, a substantially rectangular shadow mask 18 is arranged so as to face the phosphor screen 16 such that a predetermined gap is produced between the shadow mask 18 and the faceplate 4. The shadow mask 18 is formed of a thin metallic plate and has a number of slit holes 20. A mask frame 22 surrounds the peripheral surface of the shadow mask 18. The mask frame 22 is supported by a plurality of elastic supports 23. A plurality of stud pins 24 engaging the elastic supports 23 are mounted on the inner surface of the skirt 6. The mask frame 22 is provided with an internal magnetic shield 26 for reducing terrestrial magnetic influence upon the electron beams.

The three electron beams 13 emitted from the electron gun 12 are deflected by the deflecting system 14. The deflected electron beams 13 are converged in the vicinity of the slit holes 20 of shadow mask 18. The converged beams 13 are made incident on predetermined areas of phosphor screen 16 where red light, green light and blue light are produced, respectively. Thus, the electron beams 13 produced by electron guns 12 cause the red, green and blue light to be emitted from the phosphor screen 16.

In the color cathode ray tube having the above structure, the internal magnetic shield serves to reduce the terrestrial magnetic influence upon the electron beams. However, in the case where the internal magnetic shield is not provided in the color cathode ray tube, the electron beams emitted from the electron guns are influenced by terrestrial magnetism, and the trajectory thereof are changed. If the trajectory of the electron beams are changed from normal ones, the electron beams do not land on predetermined areas on the phosphor screen. The landing error leads to discoloration on the faceplate and lower picture quality.

The influence by terrestrial magnetism on a color cathode-ray tube will now be described. For example, when the faceplate of the tube is arranged to face northwards in the northern hemisphere, the landing locations of electron beams on the screen are shifted as shown in FIG. 2A. Namely, the landing locations of the beams are shifted on a screen 30 in the direction of arrow 32. On the other hand, when the faceplate is directed southwards, the landing locations of the beams are shifted on the screen 30 by terrestrial magnetism in the direction of arrow 35. This landing error often occurs in the case the internal magnetic shield is not provided.

However, even in the case where the internal magnetic shield is provided in a color cathode ray tube, the following problem may occur. FIG. 3 shows the horizontal lines of magnetic force produced in the tube having the internal magnetic shield (vertical lines of magnetic force are omitted). In this case, the faceplate faces northwards. In this type of tube, the lines of magnetic force produced between the electron gun assembly and the shadow mask are distributed, as indicated by solid lines 36. The lines of magnetic force between the shadow mask and panel section 2 are indicated by solid lines 38. In other words, in the case where the internal magnetic shield 26 is not provided, the lines of magnetic force are distributed as shown by broken lines 40. In contrast, with the provision of shield 26, the lines of magnetic force are changed, as shown by solid lines 36 and 38. The internal magnetic shield 26, shadow mask 18 and mask frame 22, which are formed of magnetic material, constitute a magnetic circuit (a region of low magnetic resistance). As a result, the magnetic flux density in a region within the magnetic circuit (a region through which electron beams pass) is reduced to 1/10. Namely, since the lines 36 of magnetic force are changed through the magnetic members, or the internal magnetic shield 26, shadow mask 18 and mask frame 22, the magnetic flux density in the region where electron beams 13 pass is decreased.

The lines 36 of magnetic force, which have passed through the shadow mask 18, becomes lines of 38 of magnetic force which extend through a vacuum and the face plate 4. The lines 38 of magnetic force are biased toward the tube axis. As a result, the magnetic flux density of lines 38 in the vicinity of the shadow mask 18 becomes higher than that of normal lines 40 of magnetic force. Thus, the electron beams incident on the phosphor screen are intensely influenced, and the problem of a landing error of electron beams remains unsolved.

FIG. 4 shows mask frame 22 disclosed in Japanese Patent Disclosure No. 43242/88, which is designed to reduce the landing error of electron beams. The mask frame has a spring-like metallic support 42 for elastically supporting shadow mask 18. FIG. 5 shows lines of magnetic force produced in the color cathode ray tube in which the support 42 is used. The use of the support 42 prevents the lines of magnetic force from being emitted from the shadow mask 18. In this case, the lines of magnetic force are almost emitted from the mask frame 22. Thus, the magnetic influence on the electron beams produced between the shadow mask and the phosphor screen is reduced, and the landing error of the electron beams is reduced.

However, if the spring-like support 42 is used in a color cathode ray tube used in a recently developed large-sized high-definition television set having an aspect ratio of 16:9, above-described landing error of electron beams in a direction shown in FIG. 2A or FIG. 2B occurs. In this case, when a faceplate of this tube is arranged to face northwards, the landing locations of the beams are shifted in the direction the arrow shown in FIG. 2A. When the faceplate is arranged to face southwards, the landing locations of the beams are shifted in the direction of the arrow shown in FIG. 2B. Namely, the landing locations of the beams are changed so as to circulate over the faceplate. FIG. 6 shows the sum (N/S beam movement amount) of the amount of the landing error in the case of FIG. 2A (the faceplate facing northwards) and the amount of the landing error in the case of FIG. 2B (the faceplate facing southwards). In FIG. 6, the sum of the landing errors at a corner is 98 μm, the sum of the landing errors at an end area on a horizontal axis (X-axis) is 63 μm, and the sum of the landing errors at an end area on a vertical axis (Y-axis) is 33 μm. Substantially no landing error appears at a central area on the faceplate.

In a color cathode ray tube used in a 36-inch high-definition television set having a resolution of 1000, the pitch of each aperture of a shadow mask is 0.39 to 0.48 mm. Thus, as shown in FIG. 7, the diameter $\phi d$ of each phosphor dot 41 on a phosphor screen is about 170 μm, and the diameter $\phi b$ of a spot 43 of each electron beam is about 240 μm. Sine a tolerance of a landing error of each electron beam is about 35 μm, an allowance of color purity is very small. Thus, the landing error of the beams, mentioned above, leads to degradation of color purity.

The degradation of color purity can be corrected to some extent by a terrestrial magnetism correction coil 44 shown in FIGS. 8A and 8B. The coil 44 is supplied with a DC current to produce a magnetic field in a direction opposite to the direction of terrestrial magnetism. FIG. 9A shows a landing error of electron beams in the case where an electric current is not caused to flow in the terrestrial magnetism correction coil 44 used in color cathode ray tube of a 36-inch 90°-deflection type high-definition television set. The landing error of electron beams at a corner area is 49 μm, the landing error at an end area on an X-axis is 32 μm, and the landing error at an end area on a Y-axis is 17 μm. FIG. 9B shows the landing error of election beams when the coil 44 is supplied with an electric current to correct the landing error. In FIG. 9B, the landing error at a corner area is zero, but the landing error at the end area on the X-axis becomes 17 μm, and the landing error at the end area on the Y-axis becomes 32 μm. Namely, the correction by the terrestrial magnetism correction coil becomes excessive at the end areas on the X- and Y-axes. Under the circumstance, the correction by the terrestrial magnetism correction coil is not satisfactory.

SUMMARY OF THE INVENTION

The present invention has been devised under the above circumstance, and the object of this invention is to provide a color cathode ray tube having a high color purity, wherein lines of magnetic force of terrestrial magnetism are prevented from acting on electron beams.

The cathode ray tube of the present invention comprises: a vacuum envelope comprising a panel section, a funnel section and a neck section, the panel section having an axis and a faceplate, a front view shape of which is substantially rectangular and which has an inner surface and having a skirt extending from a peripheral edge of the faceplate, the funnel section being continuous to the neck section; a phosphor screen formed on the inner surface of the faceplate; a shadow mask arranged in the panel section to oppose the phosphor screen on the faceplate; a mask frame arranged around the shadow mask; a magnetic resistance section provided between the shadow mask and the mask frame; and an electron gun assembly housed in the neck section.

According to the present invention, the landing error of electron beams on the phosphor screen can be reduced, and a color cathode ray tube having a very high picture quality can be provided.

DETAILED DESCRIPTION OF THE PREFERRED EMBODIMENT

An embodiment of the present invention will now be described with reference to the accompanying drawings.

Figure 10:
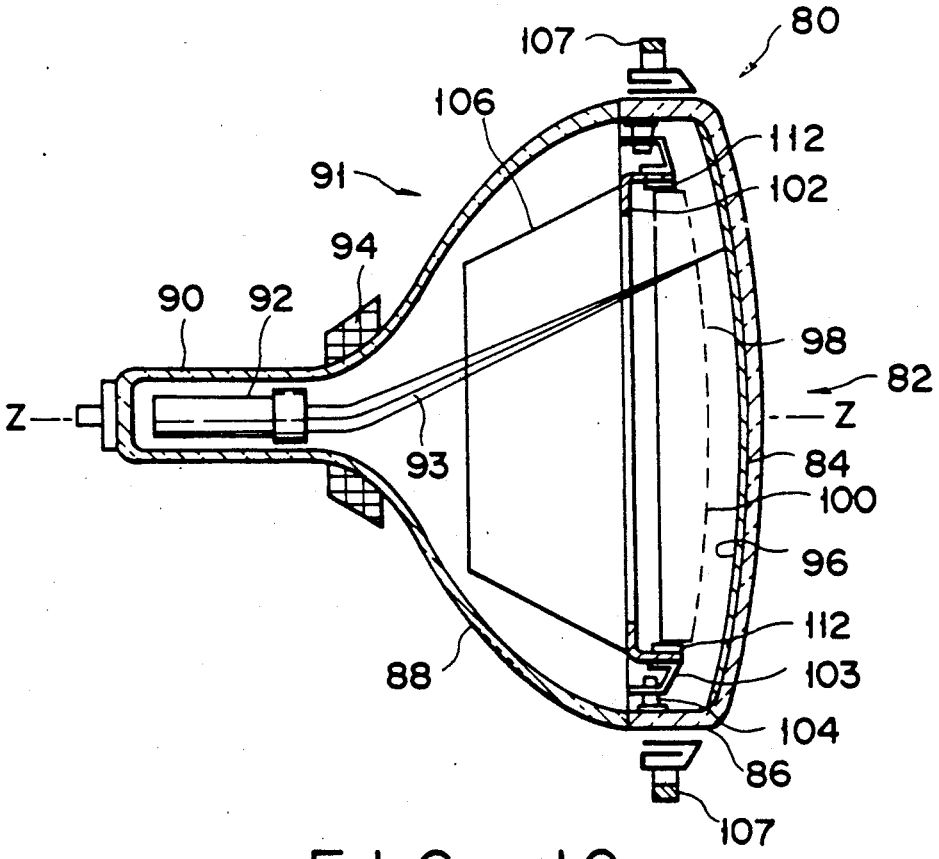
FIG. 10 is a cross section showing a color cathoderay tube according to an embodiment of the present invention.

FIG. 10 shows a color cathode ray tube according to an embodiment of the present invention. A color cathode ray tube 80 comprises a panel section 82 including a faceplate 84, having a substantially rectangular shape, and a skirt 86 extending from the edge of the faceplate 84, and an envelope 91 including a funnel section 88 connected to the panel section 82 and neck section 90 continuous to the funnel section 88. A vacuum is created in the cathode-ray tube 80 by the panel section 82, funnel section 88 and neck section 90. An electron gun assembly 92 for producing three electron beams 93 is housed in the neck section 90. A deflecting system 94 is arranged on the outside of the cone section the funnel section 88. The deflecting system 94 produces a magnetic field to deflect the electron beams 93 in a horizontal direction and in a vertical direction. A phosphor screen 96 is formed on the inner surface of faceplate 84 of panel section 82. Within the tube 80, a substantially rectangular shadow mask 98 is arranged so as to face the phosphor screen 96 such that a predetermined gap is produced between the shadow mask 98 and the faceplate 84. The shadow mask 88 is formed of a thin metallic plate and has a number of slit holes 100. A mask frame 102 surrounds the peripheral surface of the shadow mask 98. The mask frame 102 is supported by a plurality of elastic supports 103. A plurality of stud pins 104 engaging the elastic supports 103 are mounted on the inner surface of the skirt 86. The mask frame 102 is provided with an internal magnetic shield 106 for reducing magnetic influence upon the electron beams. Terrestrial magnetism correction coil 107 is arranged at the outer surface of envelope 91 and near skirt 86.

The three electron beams 93 emitted from the electron gun 92 are deflected by the deflecting system 94. The deflected electron beams 93 are converged in the vicinity of the slit holes 100 of shadow mask 98. The converged beams 93 are made incident on predetermined areas of phosphor screen 96 where red light, green light and blue light are produced, respectively. Thus, the electron beams 93 produced by electron gun 92 cause the red, green and blue light to be emitted from the phosphor screen 96.

The shadow mask is made of 99% of Fe and 0.03 to 0.04% of Al, and has a magnetic permeability of $9.30\times10^{-4}$ H/m (relative magnetic permeability is 740). The mask frame 102 is made of a material containing lowcarbon steel as a main component, and is formed of a plate having a thickness of 0.8 mm and an L-shaped cross section. The magnetic permeability of the mask frame 102 is $6.28\times10^{-4}$ H/m (relative magnetic permeability is 500).

Figure 11:
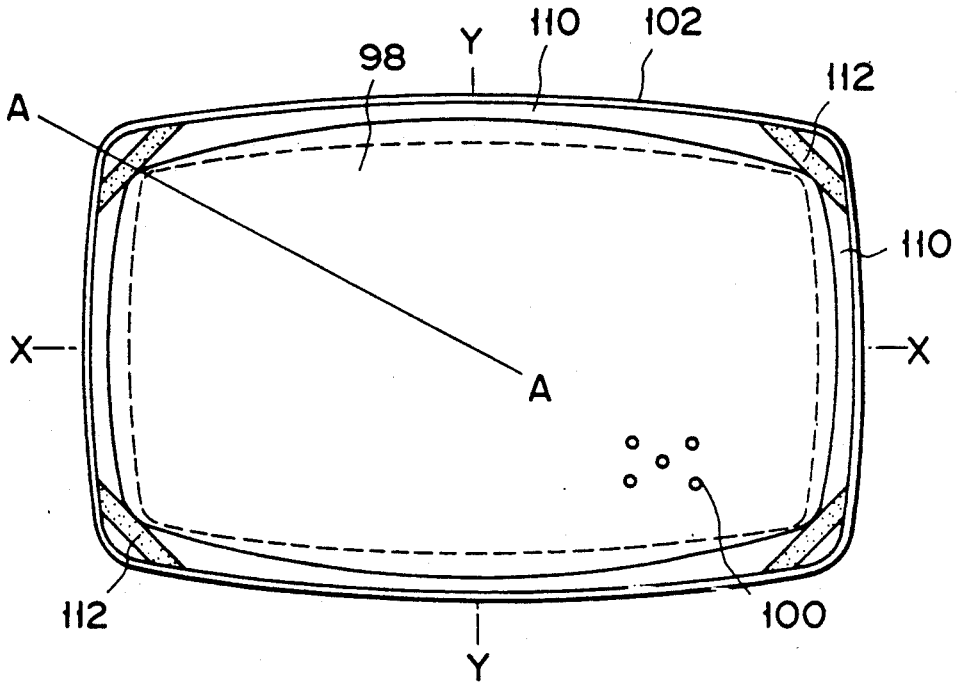
FIG. 11 is a plan view of the color cathode ray tube shown in FIG. 10.

As shown in FIG. 11, a gap 110 is provided between the shadow mask 98 and the mask frame 102. The width of gap 110 is smallest at a central area of a longer side of mask frame 102, and is second smallest at a central area of a shorter side of mask frame 102. The width of the gap increases towards each corner of mask frame 102, and becomes greatest at the corner. At each corner of mask frame 102, the width of the gap 110 is equal to or greater than the thickness of the mask frame 102. In order to fix shadow mask 98 to mask frame 102, four magnetic resistance members 112, which are each made of a non-magnetic material or a magnetic material having a lower magnetic permeability than that of that of shadow mask 98 or mask frame 102, are arranged at the corresponding four corners of mask frame 102. Each magnetic resistance member 112 has a thickness of 1.0 mm and is made of a non-magnetic stainless steel (SUS304L, SUS302) having a magnetic permeability of about $1.257\times10^{-6}$ H/m (relative magnetic permeability is about 1). The shadow mask 98 is fixed to the mask frame 102 via the magnetic resistance members 112.

Figure 12A:
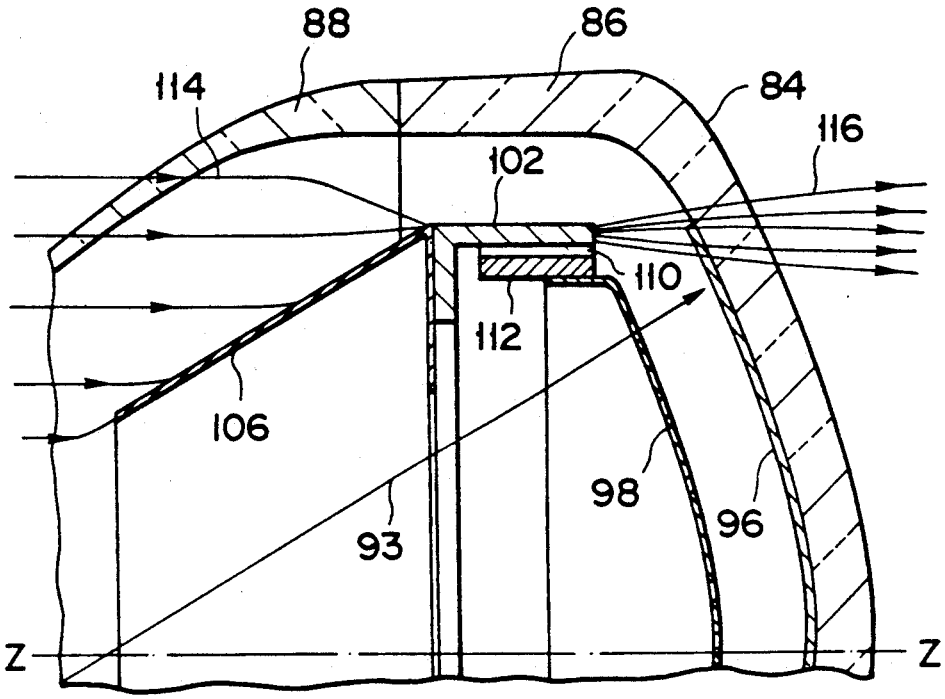
FIG. 12A is a cross section taken along line A—A in FIG. 11, showing lines of magnetic force in a corner area of the shadow mask of the color cathode ray tube shown in FIG. 10.
Figure 12B:
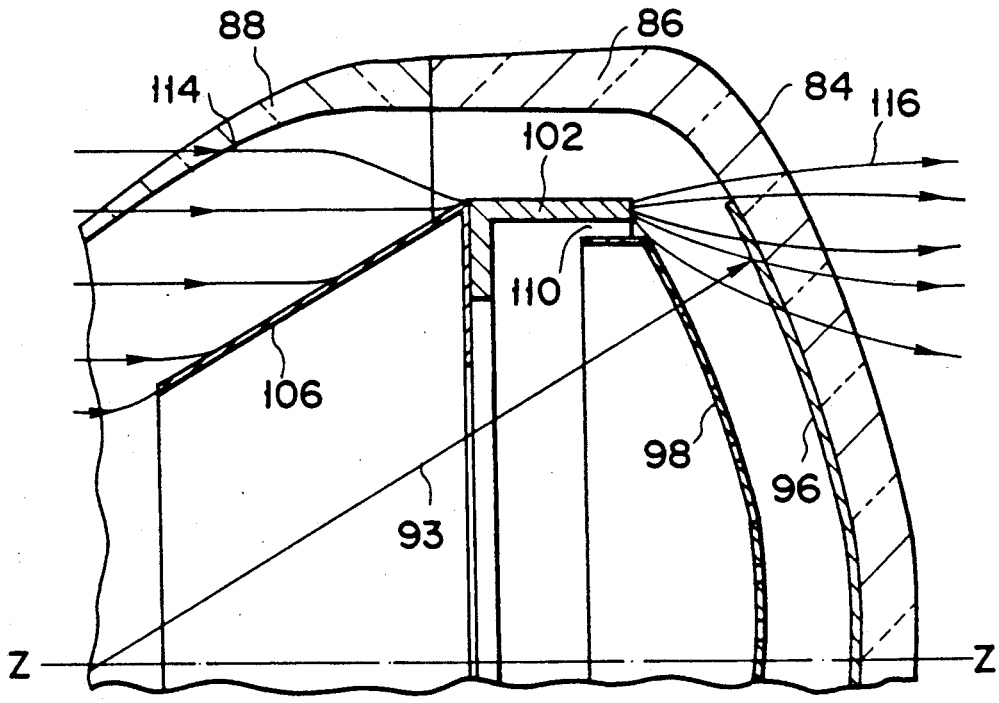
FIG. 12B is a cross section showing lines of magnetic force at a central area of each peripheral side of the shadow mask of the color cathode ray tube shown in FIG. 10.

FIGS. 12A and 12B show lines of terrestrial magnetic force produced in the faceplate of the color cathode ray tube 80 which is arranged to face northwards. FIG. 12A shows a corner area of the tube 80, and FIG. 12B shows a part of a peripheral area of the tube 80 on the X-axis or Y-axis. In FIG. 12A, magnetic resistance member 112 for fixing shadow mask 98 to mask frame 102 is arranged between shadow mask 98 and mask frame 102, and gap 110 is provided between the magnetic resistance member 112 and the mask frame 102. In FIG. 12B, gap 110 is provided between shadow mask 98 and mask frame 102. Lines 114 of magnetic force produced in a region closer to internal magnetic shield 106 than to shadow mask 98 are collected by magnetic shield 106. The lines 114 of magnetic force pass through internal magnetic shield 106 and mask frame 102, and then the lines 114 are radiated as lines 116 of magnetic force. The lines 116 of magnetic force do not flare in a wide range, and pass through a region near the periphery of phosphor screen 96.

In the tube 80, magnetic resistance member 112 is provided, and also gap 110 is provided. Thus, lines 116 of magnetic force are rarely radiated through shadow mask 98, and electron beam 93 which has passed through shadow mask 98 is not deflected by the lines of 116 of magnetic force and is landed on phosphor screen 96. Since the width of gap 110 between shadow mask 98 and mask frame 102 is smaller in the corner area than in the areas on the X- and Y-axes, the lines 116 of magnetic force are biased toward the tube axis.

Figure 1:
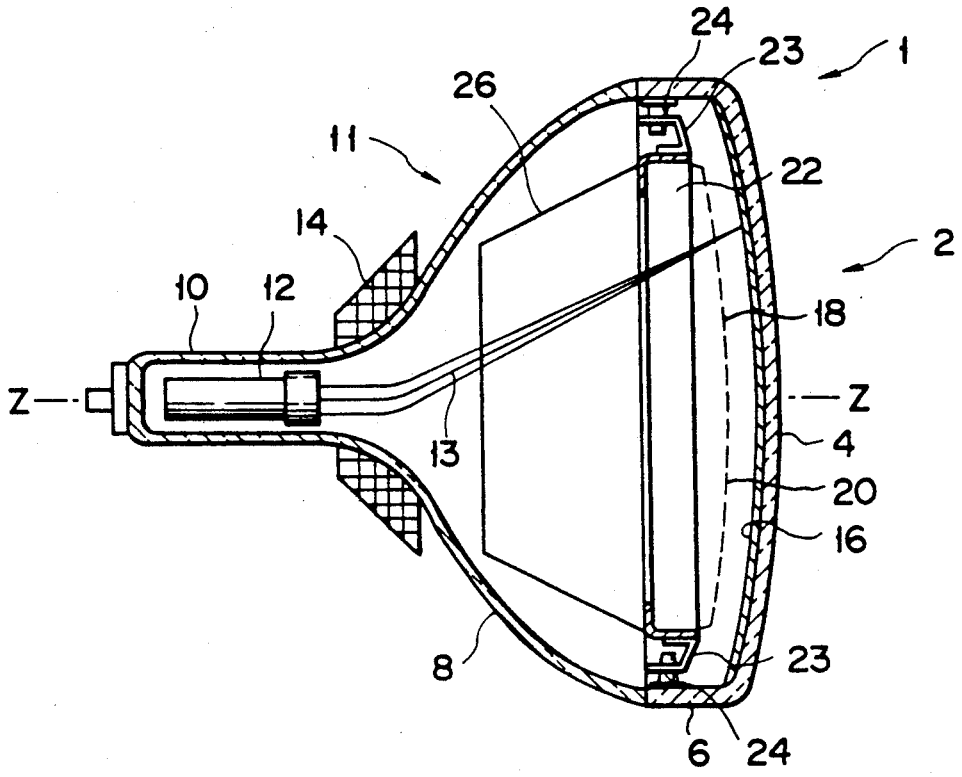
FIG. 1 PRIOR ART
FIG. 1 is a cross section of a conventional color cathode ray tube.
Figure 2A:
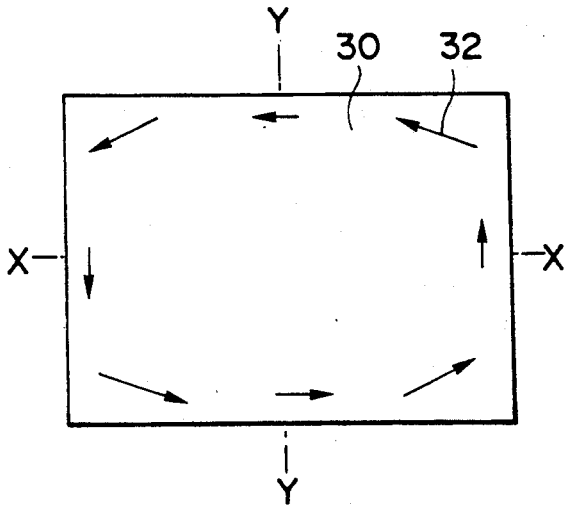
FIG. 2A PRIOR ART
FIG. 2A is a plan view showing a direction of a landing error of electron beams on a faceplate of a cathode ray tube, when the faceplate is arranged to face northwards.
Figure 2B:
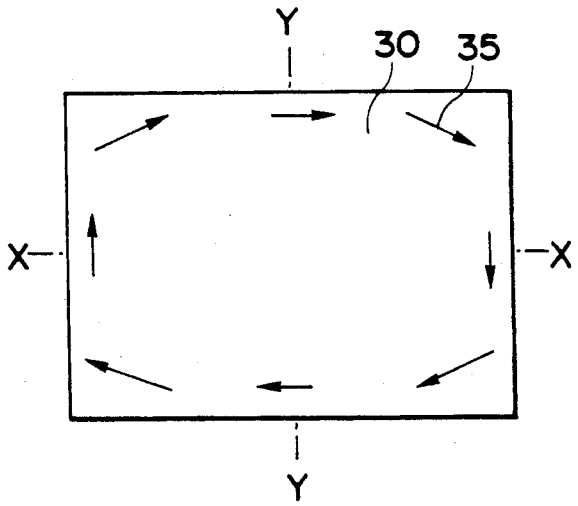
FIG. 2B PRIOR ART
FIG. 2B is a plan view showing a direction of a landing error of electron beams on a faceplate of a cathode ray tube, when the faceplate is arranged to face southwards.
Figure 3:
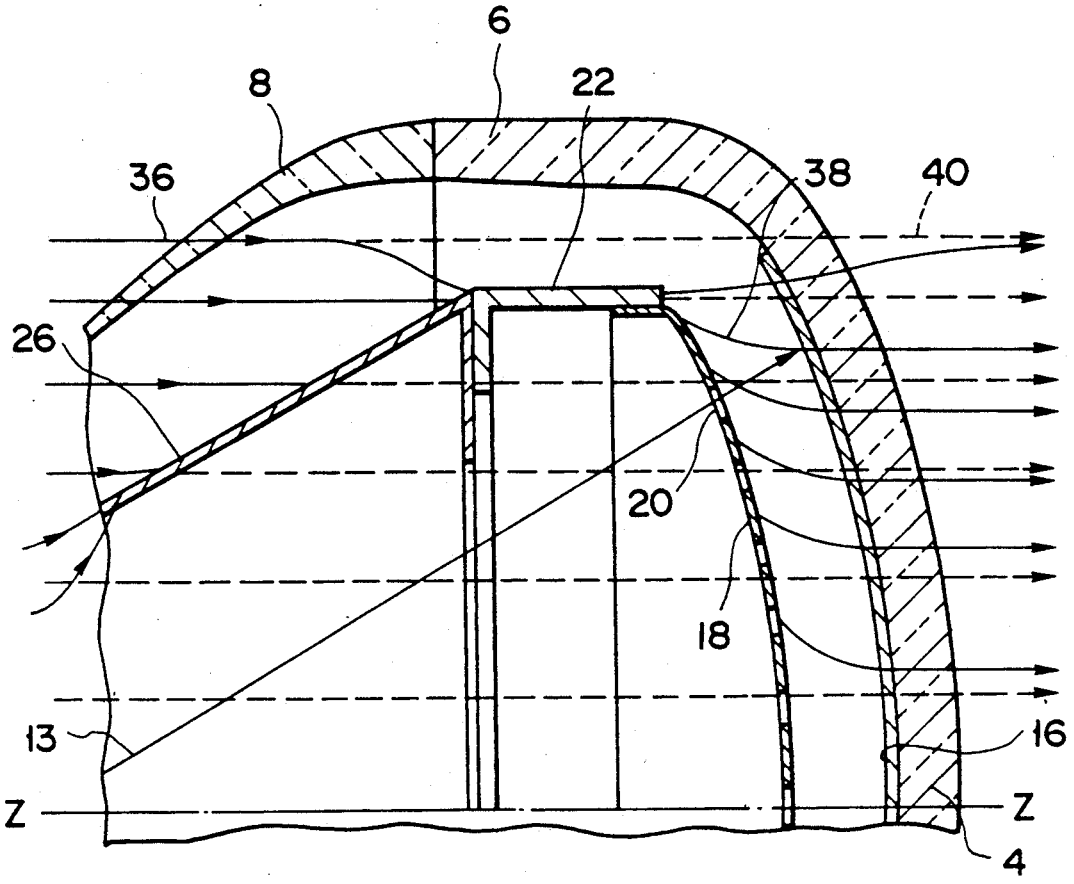
FIG. 3 PRIOR ART
FIG. 3 is a cross section showing lines of magnetic force in a conventional color cathode ray tube.
Figure 4:
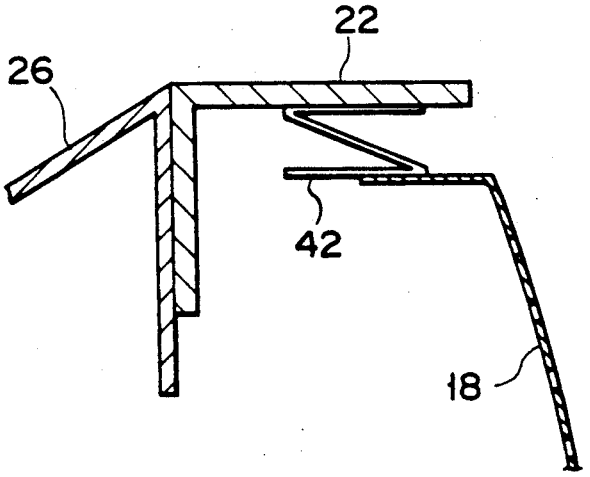
FIG. 4 PRIOR ART
FIG. 4 is an enlarged cross section of an area in the vicinity of a shadow mask in a conventional color cathode ray tube.
Figure 5:
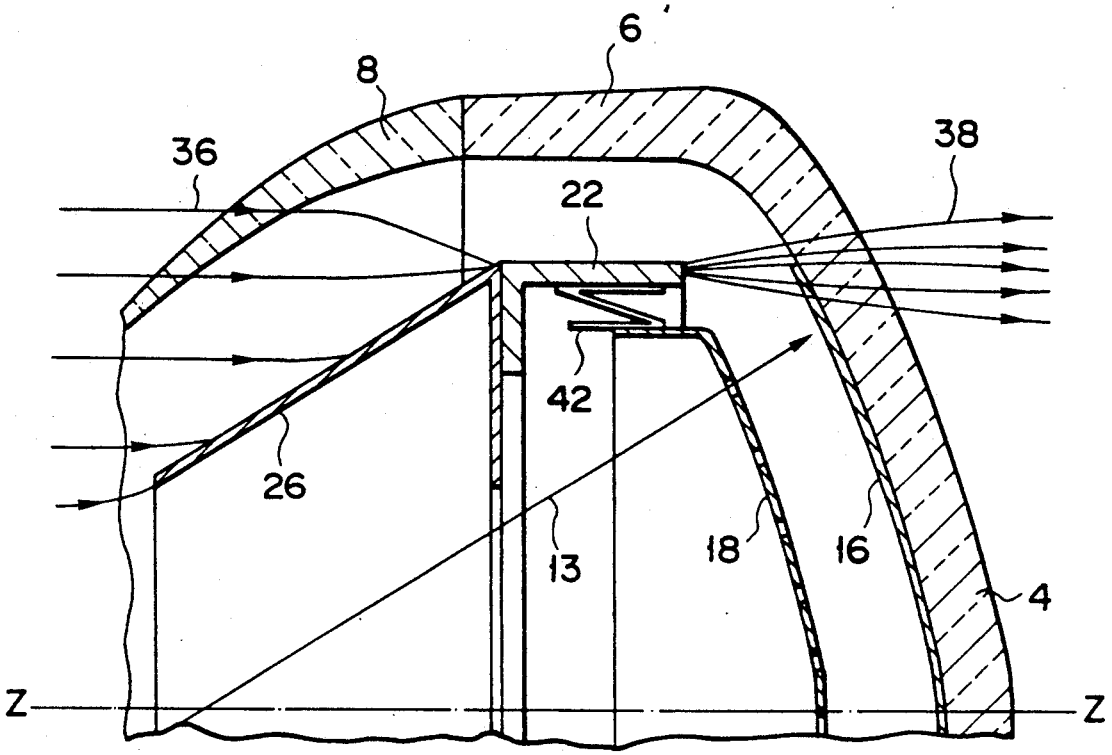
FIG. 5 PRIOR ART
FIG. 5 is a cross section showing lines of magnetic force produced when the conventional structure shown in FIG. 4 is employed.
Figure 6:
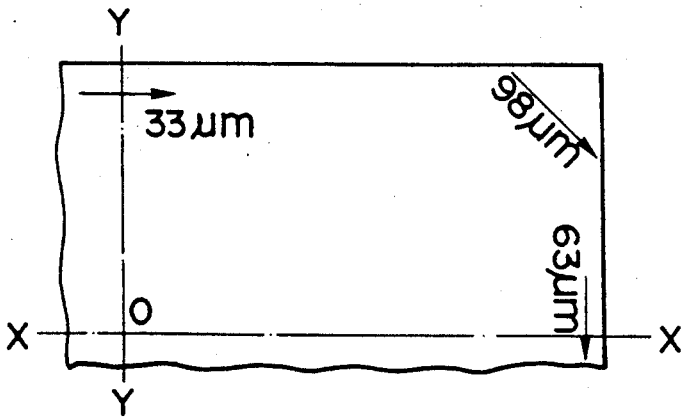
FIG. 6 PRIOR ART
FIG. 6 is a plan view illustrating a landing error of electron beams on a faceplate of a color cathode ray tube.
Figure 7:
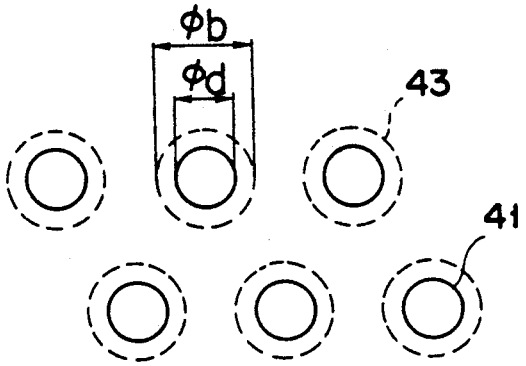
FIG. 7 PRIOR ART
FIG. 7 is an enlarged plan view showing dots on a phosphor screen and beam spots of electron beams.
Figure 8A:
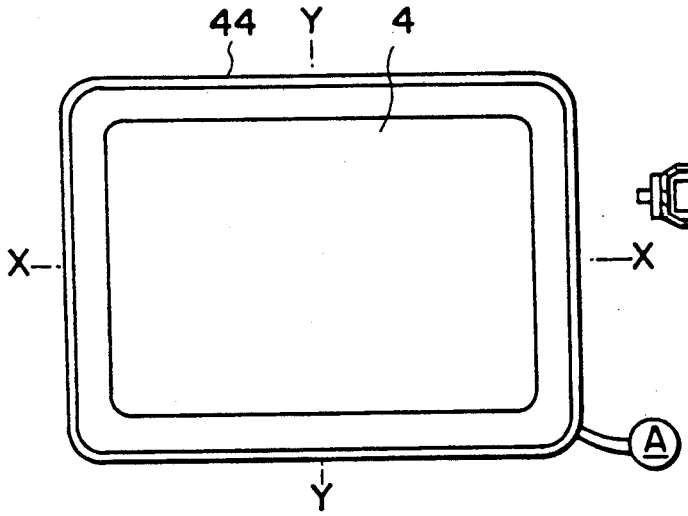
FIG. 8A PRIOR ART
FIG. 8A is a plan view showing a conventional color cathode ray tube around which a terrestrial magnetism correction coil is provided.
Figure 8B:
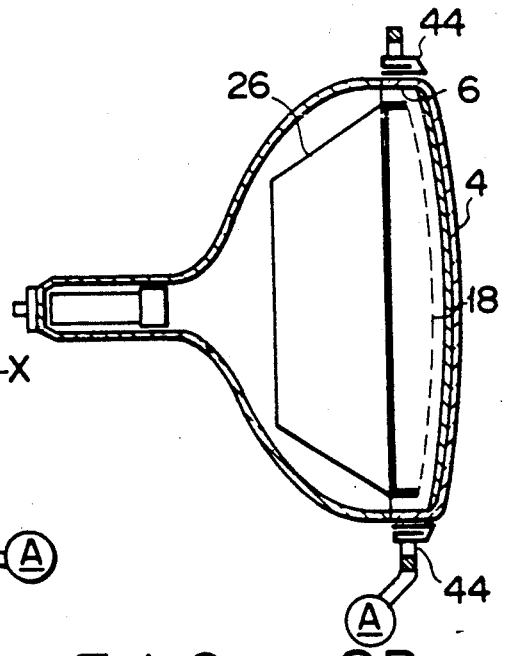
FIG. 8B PRIOR ART
FIG. 8B is a cross section showing the conventional color cathode ray tube shown in FIG. 8A.
Figure 9A:
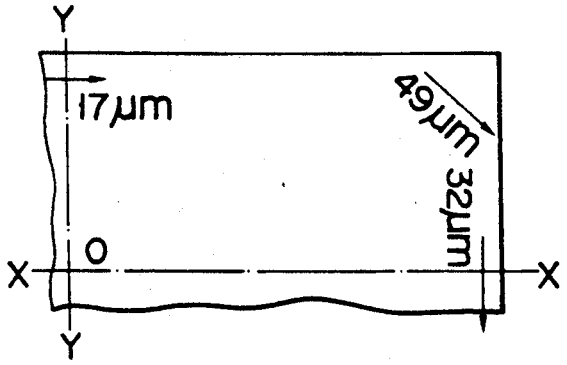
FIG. 9A PRIOR ART
FIG. 9A is a plan view illustrating a landing error of electron beams on the faceplate shown in FIGS. 8A and 8B, when an electric current is not caused to flow through the terrestrial magnetism correction coil.
Figure 9B:
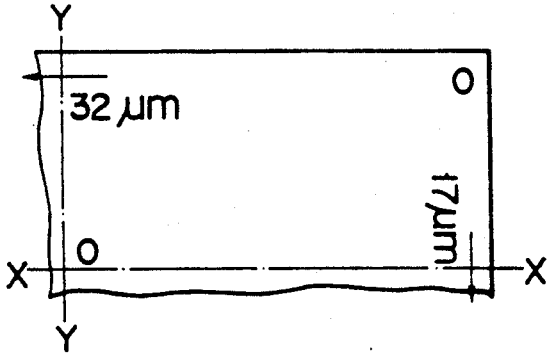
FIG. 9B PRIOR ART
FIG. 9B is a plan view illustrating a landing error of electron beams on the faceplate shown in FIGS. 8A and 8B, when an electric current is caused to flow through the terrestrial magnetism correction coil.
Figure 13A:
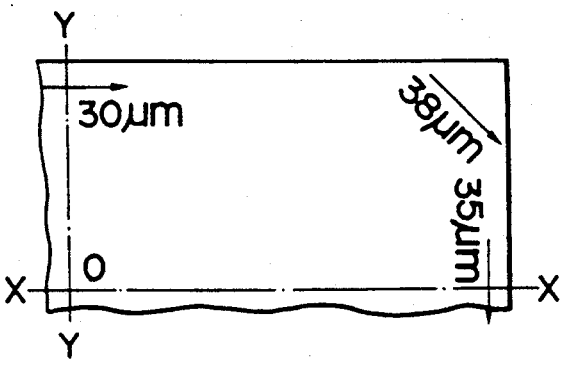
FIG. 13A is a plan view illustrating a landing error of electron beams on the faceplate of the color cathode ray tube shown in FIG. 10, when an electric current is not caused to flow through a terrestrial magnetism correction coil.
Figure 13B:
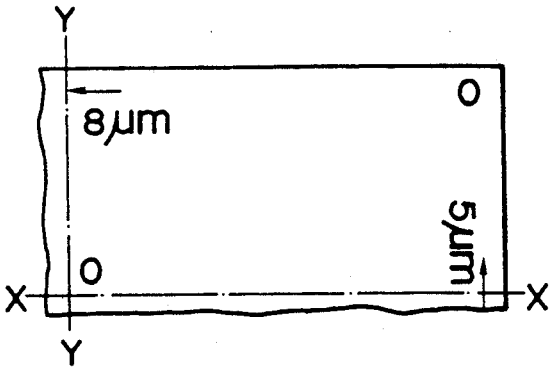
FIG. 13B is a plan view illustrating a landing error of electron beams on the faceplate of the color cathode ray tube shown in FIG. 10, when an electric current is caused to flow through the terrestrial magnetism correction coil.

The magnetic field intensity of a region between shadow mask 98 and mask frame 102 successively decreases in the area on the X-axis, the area on the Y-axis, and the corner area, in this order. FIG. 13A shows landing errors of electron beams in this embodiment, in the case where an electric current is not caused to flow through the terrestrial magnetism correction coil. Namely, the landing error in the area on the X-axis is 35 μm, that in the area on the Y-axis is 30 μm, and that in the corner section is 38 μm. Compared to the difference between the maximum landing error and the minimum landing error in the prior art shown in FIG. 9A, that is, $49-17=32$ μm, the difference in this embodiment is small, that is, $38-30=8$ μm. FIG. 13B shows landing errors of electron beams in this embodiment, in the case where an electric current is caused to flow through the terrestrial magnetism correction coil. Namely, the landing error in the area on the X-axis is 5 μm, that in the area on the Y-axis is 8 μm, and that in the corner section is zero. Since the difference between the maximum landing error and the minimum landing error is small, the lading errors can be easily corrected by the terrestrial magnetism correction coil.

In the above embodiment, the faceplate of the tube is arranged to face southwards. In the case where the faceplate is arranged to face northwards, the directions of the lines of magnetic force are reversed. Even if the directions of the lines of magnetic force are reversed, the amount of landing errors is unchanged. Thus, the same correction of the landing errors can be performed by reversing the direction of the electric current supplied to the terrestrial magnetism correction coil. In addition, even if the faceplate is arranged in other direction, the landing errors of beams can be suitably corrected by causing a suitable electric current to flow through the terrestrial magnetism correction coil in accordance with the intensity of the terrestrial magnetism.

In the above embodiment, the landing errors of electron beams are substantially uniform over the entire surface of the shadow mask. Since the landing errors can be efficiently corrected by the terrestrial magnetism correction coil, a color cathode ray tube having a high color purity can be manufactured.

Figure 14:
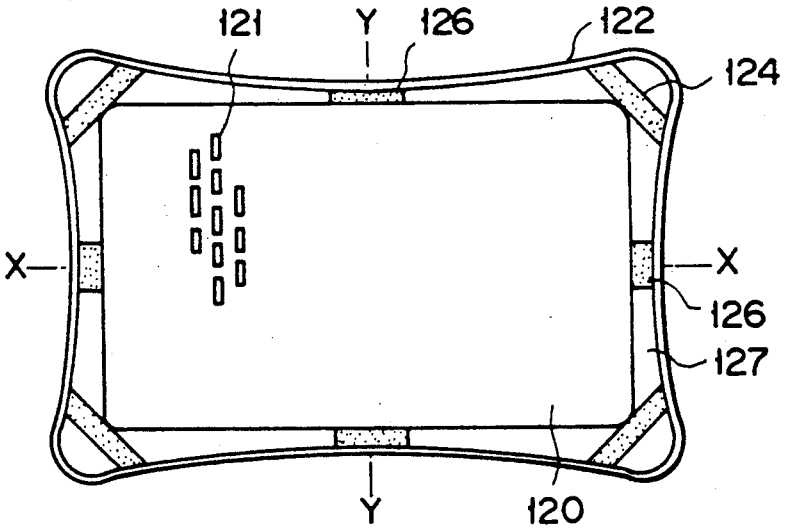
FIG. 14 is a plan view showing a first modification of the embodiment of the present invention.

FIG. 14 shows a first modification of the above embodiment of the present invention. A number of holes 121 are formed in shadow mask 120. The shadow mask 120 is fixed to a mask frame 122 having curved four sides. Magnetic resistance members 124 are provided at corner areas between shadow mask 120 and mask frame 122, and other magnetic resistance members 126 are provided at central areas of the sides of mask frame 122. A gap 127 is produced between shadow mask 120 and mask frame 124. The width of gap 127 is smallest at a central area of a longer side of mask frame 122 and second smallest at a central area of a shorter side of mask frame 122. The width of the gap gradually increases from the central area of each side towards each corner area. The width of gap 127 becomes largest at each corner area. At the corner area, the width of the gap is equal to or larger than the thickness of the mask frame 122. The shadow mask of a conventional shape can be used by forming shadow mask 122 having the above shape. The magnetic resistance members 126 provided at central areas of the four sides of mask frame 122 increase the mechanical strength of shadow mask 120. In addition, since each side of mask frame 122 is curved, the degree of freedom of design of mask supports (not shown) attached to mask frame 122 is increased. The same advantages as are obtainable with the above-described embodiment can be obtained with the first modification. It is possible to arrange only magnetic resistance members between shadow mask 120 and mask frame 122 at the corners, without using magnetic resistance members 126. Inversely, it is possible to arrange only magnetic resistance members at the mid-portions of the each sides, without using magnetic resistance members 124.

Figure 15:
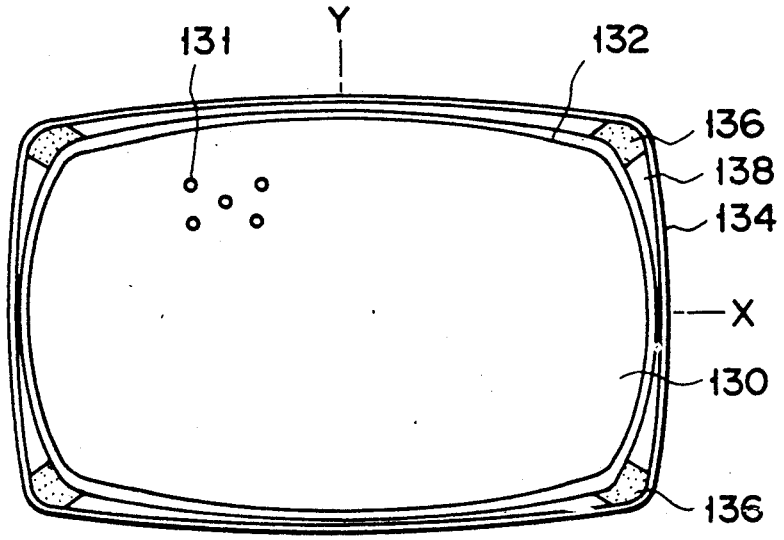
FIG. 15 is a plan view showing a second modification of the embodiment of the present invention.

FIG. 15 shows a second modification of the above-described embodiment of the present invention. A number of holes 131 are formed in shadow mask 130. A magnetic resistance member 132 formed of a non-magnetic stainless steel band or an aluminum band is provided around shadow mask 130. The shadow mask 130 is attached on mask frame 134 having four curved sides. Magnetic resistance members 136 are provided at areas between the magnetic resistance member 132 and mask frame 134. A gap 138 is produced between shadow mask 130 and mask frame 134. The width of gap 138 is smallest at a central area of a longer side of mask frame 134, and second smallest at a central area of a shorter side of mask frame 134. The width of gap 138 gradually increases from the central areas of the four sides of mask frame 134 towards corner areas of mask frame 134. The width of gap 138 is largest at the corner areas. In the case where the magnetic resistance members 132 are attached to the shadow mask, as described above, the magnetic resistance between the shadow mask and the mask frame increases, and the gap 138 between the shadow mask and the mask frame can be made smaller. Thus, the mechanical strength of the shadow mask can be enhanced, without lowering the magnetic resistance. The same advantages as are obtainable with the above-described embodiment can be obtained by this second modification.

The shadow mask may be made of iron or invar containing 62.9% of Fe and 36.4% of Ni and having a magnetic permeability of $4.02\times10^{-3}$ H/m (relative magnetic permeability is 3200). The thickness of the shadow mask, if made of invar, is 0.8 mm. It is desirable that the magnetic resistance member be made of a material having a lowest possible magnetic permeability, for example, Cr, Al, Cu, or glass.

In the above embodiment, the color cathode ray tube is provided with an internal magnetic shield. However, the tube may not be provided with such a magnetic shield. In this case, a color cathode ray tube having similar advantages can also be manufactured.

When the present invention is applied to a large-sized color cathode ray tube used in a high-definition television set having a aspect ratio of 16:9, pictures having very high color purity can be obtained.

What is claimed is:

1. A color cathode ray tube comprising:

a vacuum envelope comprising a panel section, a funnel section and a neck section, the panel section having an axis and a faceplate, a front view shape of which is substantially rectangular and which has an inner surface and having a skirt extending from a peripheral edge of said faceplate, and the funnel section being continuous to said neck section;

a phosphor screen formed on said inner surface of said faceplate;

a shadow mask arranged in said panel section to oppose said phosphor screen on said faceplate;

a mask frame, having an outer circumferential region, arranged around said shadow mask;

a plurality of nonmagnetic members interspaced with a plurality of gaps provided between said shadow mask and said mask frame over the entire mask frame outer circumferential region; and an electron gun assembly housed in said neck section.

2. The tube according to claim 1, wherein said nonmagnetic members are made of a material such as Cr, Al, Cu or glass.

3. The tube according to claim 1, wherein said nonmagnetic members are made of stainless steel (SuS304L, SUS302) having a magnetic permeability of less than about $1.257\times10^{-6}$ H/m, and a relative magnetic permeability of about 1.

4. The tube according to claim 1, wherein said nonmagnetic members are provided at areas between said shadow mask and four corners of said mask frame.

5. The tube according to claim 1, wherein said nonmagnetic members are provided at areas between said shadow mask and central portions of four sides of said mask frame.

6. The tube according to claim 1, wherein said nonmagnetic members are provided at areas between said shadow mask and four corners of said mask frame, and at areas between said shadow mask and central portions of the four sides of said mask frame.

7. The tube according to claim 1, wherein said nonmagnetic members are provided with a band of a nonmagnetic stainless steel or aluminum arranged around said shadow mask.

8. The tube according to claim 1, wherein said gap between said shadow mask and said mask frame is gradually changed such that the gap is largest at an area of each corner of said mask frame and is smallest at a central area between adjacent two of the corners of said mask frame.

9. The tube according to claim 1, wherein said gap between said shadow mask and said mask frame is largest at an area of each corner of said mask frame, the width of said largest gap being equal to or greater than the thickness of said mask frame.

10. The tube according to claim 1, wherein said mask frame arranged around said shadow mask is formed such that a central portion of each side of said mask frame is curved outwards.

11. The tube according to claim 1, wherein said mask frame arranged around said shadow mask is formed such that each corner portion of said mask frame is curved outwards and a central portion of each side of said mask frame is curved inwards.

12. The tube according to claim 1, wherein the thickness of said nonmagnetic material or the width of said gap is gradually changed such that this value is highest at each corner portion of the magnetic resistance section.

13. The tube according to claim 1, wherein at least nonmagnetic materials or gaps are provided between said shadow mask and said frame such that the thickness of said nonmagnetic material or the width of said gap is gradually changed to permit the value of said thickness or width to be largest at corner portions and smallest at the central portion between adjacent corner portions.

14. A color cathode ray tube comprising:

a vacuum envelope comprising a panel section, a funnel section and a neck section, the panel section having an axis and a faceplate, a front view shape of which is substantially rectangular and which has an inner surface and having a skirt extending from a peripheral edge of said faceplate, and the funnel section being continuous to said neck section;

a phosphor screen formed on said inner surface of said faceplate;

a shadow mask arranged in said panel section to oppose said phosphor screen on said faceplate;

a mask frame having an outer periphery arranged around said shadow mask;

a plurality of nonmagnetic members interspaced with a like plurality of gaps provided between said shadow mask and said mask frame over the entire outer periphery of the mask frame; and an electron gun assembly housed in said neck section.

* * * * *